US008974244B2

(12) United States Patent
Aihara

(10) Patent No.: US 8,974,244 B2
(45) Date of Patent: Mar. 10, 2015

(54) CONNECTOR

(75) Inventor: Tetsuya Aihara, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 253 days.

(21) Appl. No.: 13/805,910

(22) PCT Filed: Jun. 9, 2011

(86) PCT No.: PCT/JP2011/063220
§ 371 (c)(1),
(2), (4) Date: Dec. 20, 2012

(87) PCT Pub. No.: WO2012/032820
PCT Pub. Date: Mar. 15, 2012

(65) Prior Publication Data

US 2013/0095686 A1 Apr. 18, 2013

(30) Foreign Application Priority Data

Sep. 8, 2010 (JP) ..... 2010-200904

(51) Int. Cl.
*H01R 13/64* (2006.01)
*H01R 13/639* (2006.01)
*H01R 12/72* (2011.01)
(Continued)

(52) U.S. Cl.
CPC ..... *H01R 13/639* (2013.01); *H01R 12/724* (2013.01); *H01R 12/721* (2013.01); *H01R 2107/00* (2013.01); *H01R 13/516* (2013.01); *H01R 13/6272* (2013.01)
USPC ..... 439/374

(58) Field of Classification Search
USPC ..... 439/374, 352, 701, 594, 599, 603, 499, 439/581, 680, 74, 345, 660, 83, 140, 565, 439/724, 354, 570–575
See application file for complete search history.

(56) References Cited

U.S. PATENT DOCUMENTS 5,632,653 A 5/1997 Sawada
6,231,398 B1 5/2001 Furutani et al.
(Continued)

FOREIGN PATENT DOCUMENTS

JP 11-307166 11/1999
JP 2002-231371 8/2002
(Continued)

OTHER PUBLICATIONS

International Search Report and Written Opinion of Jul. 5, 2011.

*Primary Examiner* — Abdullah Riyami
*Assistant Examiner* — Harshad Patel
(74) *Attorney, Agent, or Firm* — Gerald E. Hespos; Michael J. Porco; Matthew T. Hespos

(57) ABSTRACT

A harness-side connector (30) to be connected to a board connector (10) whose metal fixtures (20) are fixed to the upper surface of a board (P) by soldering include a female housing (31) connected to an end of a wiring harness and fittable into a receptacle (12) of the board connector (10) and a holder (50) formed separately from the female housing (31). The holder (50) includes lock arms (57A, 57B) which are resiliently engaged with the female housing (31) to lock the holder (5) in a state mounted on the female housing (31) and a locking portion (61) which is engaged with the lower surface of the board (P) when the female housing (31) is fitted into the receptacle (12) of the board connector (10) after the holder (50) is mounted on the female housing (31).

4 Claims, 11 Drawing Sheets

(51) Int. Cl.

| | |
|---|---|
| *H01R 107/00* | (2006.01) |
| *H01R 13/516* | (2006.01) |
| *H01R 13/627* | (2006.01) |

(56) References Cited

U.S. PATENT DOCUMENTS

| | | | | |
|---|---|---|---|---|
| 6,582,256 | B2 | 6/2003 | Sakurai et al. | |
| 7,303,445 | B2 | 12/2007 | Nakano et al. | |
| 7,371,127 | B2 * | 5/2008 | Wang | 439/676 |
| 8,403,705 | B2 * | 3/2013 | Liu et al. | 439/607.4 |
| 2005/0247476 | A1 * | 11/2005 | Aihara et al. | 174/50.52 |

FOREIGN PATENT DOCUMENTS

| | | |
|---|---|---|
| JP | 2007-87903 | 4/2007 |
| JP | 2007-165015 | 6/2007 |

* cited by examiner

CONNECTOR

BACKGROUND OF THE INVENTION

1. Field of the Invention

The present invention relates to a connector to be connected to a board connector fixed to the upper surface of a board by soldering.

2. Description of the Related Art

A board connector device disclosed Japanese Unexamined Patent Publication No. 2007-87903 is known as an example of a board connector device of this type. The board connector includes a male housing including a receptacle with an open front surface and is structured such that tab-shaped terminal fittings are accommodated in this male housing while one ends are soldered to conductive paths of a board and the other ends are located in the receptacle and metal fixtures are mounted on both left and right side surfaces of the male housing. The board connector is fixed to the upper surface of an end edge part of the board by soldering the both metal fixtures. On the other hand, a connector to be connected to the board connector is connected to an end of a wiring harness. Specifically, this connector includes a female housing into which female terminals connected to ends of a plurality of wires are inserted and accommodated from behind. By fitting this female housing into the receptacle of the male housing of the board connector, the male and female terminal fittings are connected.

Since the wires are drawn out from the rear surface of the connector (female housing) in the board connector device as described above, the male housing of the board connector is pulled and, accordingly, an excessive stress may act on soldered parts of the metal fixtures and the soldered parts may be cracked or finally broken if, for example, the wires are pulled upward during wire laying or the like.

The present invention was completed based on the above situation and aims to prevent the action of an excessive stress on soldered parts of metal fixtures in a board connector.

SUMMARY OF THE INVENTION

The present invention is directed to a connector to be connected to a board connector including a receptacle and metal fixtures provided on opposite side surfaces and fixed to the upper surface of a board by soldering, comprising a housing connected to an end of a wiring harness and fittable into the receptacle of the board connector; and a holder formed separately from the housing, wherein the holder includes a lock member which is resiliently engaged with the housing to lock the holder in a state mounted on the holder and a locking portion which is engaged with the lower surface of the board when the housing is fitted into the receptacle of the board connector after the holder is mounted on the housing.

When the housing is fitted into the receptacle of the board connector with the holder mounted on the housing, the locking portion provided in the holder is engaged with the lower surface of the board. Thus, even if wires drawn out backward from the connector are pulled upwardly of the board, the locking portion is engaged with the board, thereby restricting the inclination of the housing and, further, the board connector and eventually preventing an excessive stress from acting on soldered parts of the metal fixtures.

Since the holder is formed separately from the housing and the lock member is provided only in the holder, it is sufficient to create only a manufacturing mold for the holder anew with a manufacturing mold for the housing kept as it is. Thus, this configuration can be inexpensively dealt with.

The locking portion may be capable of sandwiching the board from upper and lower sides.

The housing and, eventually, the board connector may be possibly inclined also when the wiring harness is pulled downwardly of the board depending on conditions such as when the receptacle of the board connector largely projects from an end edge of the board. However, since the locking portion provided in the holder is capable of sandwiching the board from both upper and lower sides, downward inclination can also be restricted.

The holder may be in the form of a frame fittable onto the housing from front and includes a contact portion which restricts a pushing operation by coming into contact with a contacted portion set on the housing and a lock arm which is resiliently engaged with the rear surface of the housing to retain the holder when the contact portion comes into contact with the contacted portion.

When the frame-shaped holder is fitted onto the housing from front and pushed, the pushing operation is stopped by the contact of the contact portion with the mating contacted portion when the holder is pushed to a proper position. At that time, the lock arm is resiliently engaged with the rear surface of the housing to retain the holder, whereby the holder is locked in a state mounted at the proper position on the housing.

A retainer mount hole into which a retainer for locking and retaining terminal fittings accommodated in the housing is to be mounted may be formed in a side surface of the housing.

If the locking portion provided in the holder is structured to be integral with the housing, the arrangement position of a so-called side retainer is restricted to avoid interference when the side retainer is mounted into the housing. However, since the locking portion is provided in the holder separate from and mounted later on the housing, a degree of freedom in design for the arrangement position of the side retainer can be drastically widened.

According to the present invention, it is possible to prevent the action of an excessive stress on soldered parts of metal fixtures in a board connector.

DETAILED DESCRIPTION OF THE PREFERRED EMBODIMENTS

One embodiment of the present invention is described with reference to FIGS. 1 to 11.

Figure 1:
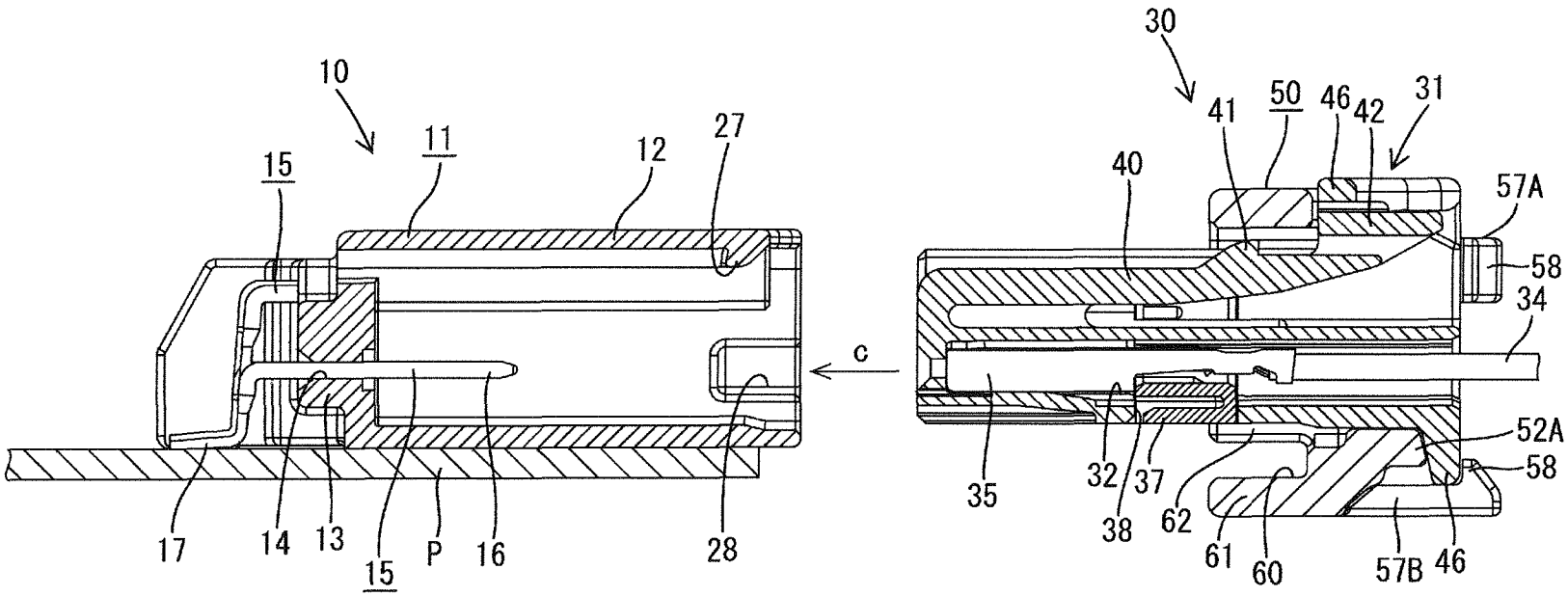
FIG. 1 is a side view in section showing an operation of connecting a harness-side connector according to one embodiment of the present invention to a board connector.

In this embodiment, as shown in FIG. 1, a harness-side connector 30 (corresponding to a connector of the present invention) connected to an end of a wiring harness is illustrated to be connected to a board connector 10 fixed to an end edge part of a printed wiring board P (hereinafter, merely referred to as a board P).

Figure 2:
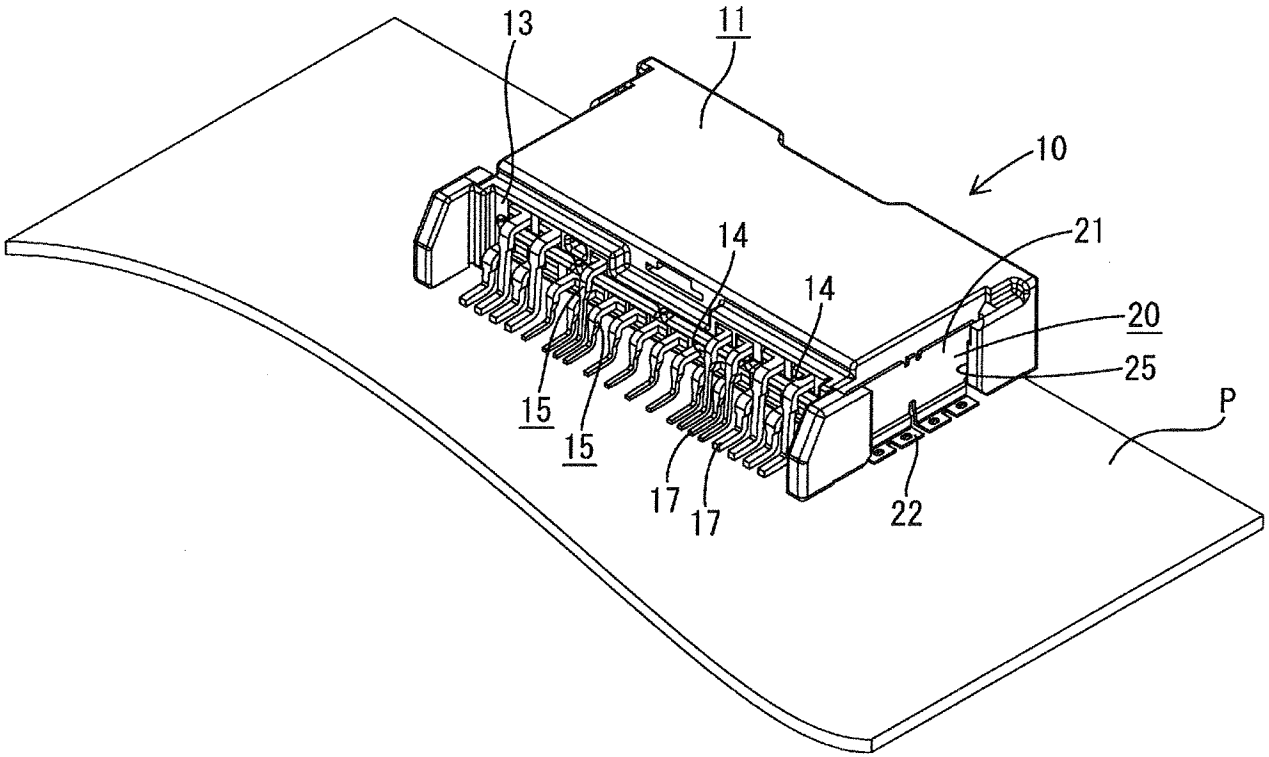
FIG. 2 is a perspective view showing a state where the board connector is fixed on a board.
Figure 3:
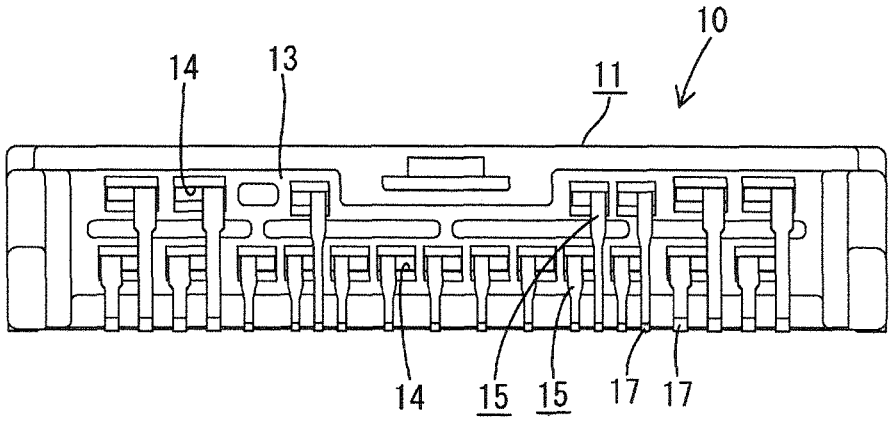
FIG. 3 is a rear view of the board connector.

As shown in FIGS. 1 to 3, the board connector 10 includes a male housing 11 made of synthetic resin. This male housing 11 includes a receptacle 12 in the form of a flat rectangular tube with an open front surface, and a thick rear wall of this receptacle 12 serves as a terminal holding portion 13.

A plurality of terminal fittings 15 are mounted through the terminal holding portion 13 while being arranged in a lateral direction in two upper and lower levels. The terminal fittings 15 are formed by bending tabs into a crank shape and there are two types of larger and smaller terminal fittings 15 which mainly differ in thickness.

Each terminal fitting 15 is mounted into a terminal press-fitting opening 14 formed in the above terminal holding portion 13 by being press-fitted thereinto from behind. Terminal connecting portions 16 of the respective terminal fittings 15 on one end side project into receptacle 12 and are arranged in the lateral direction in the two upper and lower levels, and board connecting portions 17 on the other end side are arranged side by side and respectively connected to corresponding conductive paths formed on the board P by soldering.

Fixtures 20 are mounted on both left and right surfaces of the male housing 11. Each metal fixture 20 is so formed by bending a metal plate into a substantially L shape that a mounting plate 22 bent outward at a right angle is formed at a lower end part of the main plate 21. On the other hand, mounting grooves 25 are so formed in the both left and right surfaces of the male housing 11 as to vertically penetrate, and the metal fixtures 20 are retained and fixed by press-fitting both lateral edges of the main plates 21 of the metal fixtures 20 along both lateral edges of the mounting grooves 25. At this time, the mounting plates 22 of the metal fixtures 20 are located slightly below the lower surface of the male housing 11 and fixed to fixing lands provided on the board P.

A lock protrusion 27 is formed at a widthwise center position of the front edge of the ceiling wall of the receptacle 12 of the male housing 11. Further, the inner surfaces of opposite side walls are cut at lower positions to form guide grooves 28 extending from the front edges.

Figure 4:
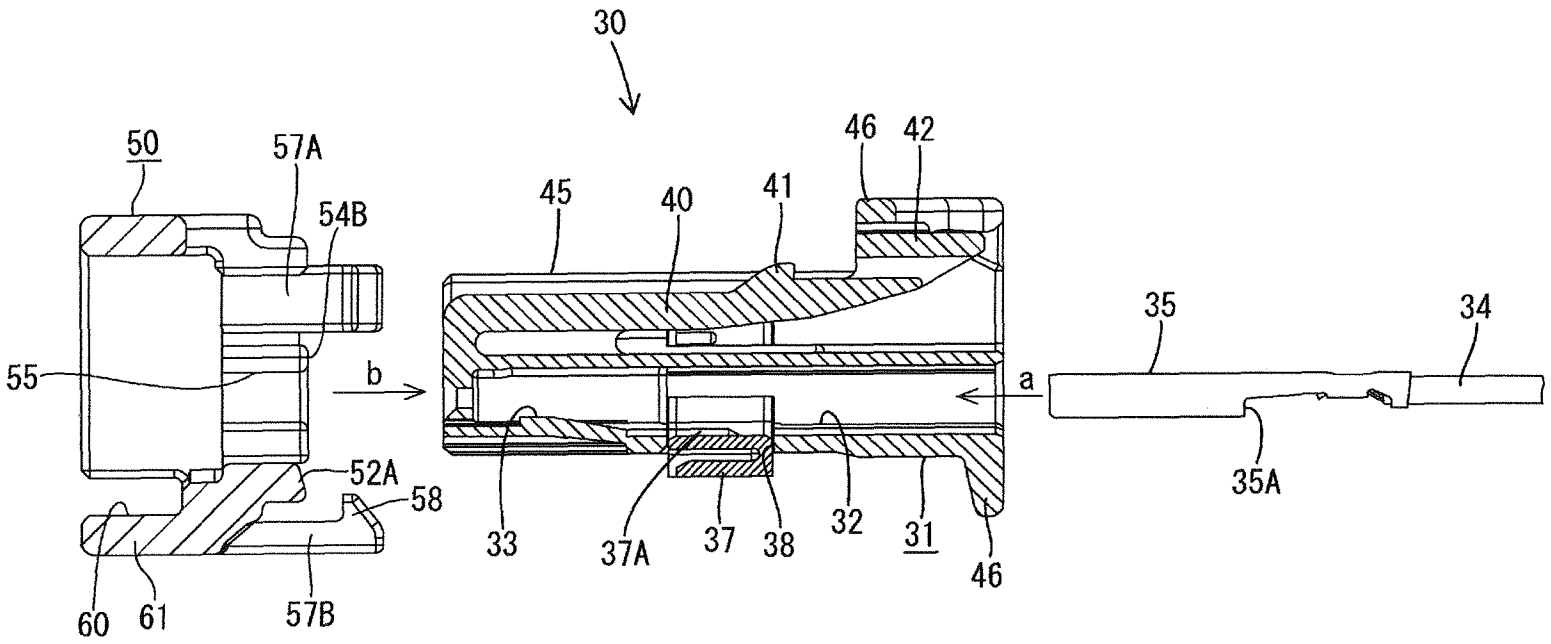
FIG. 4 is an exploded side view in section of the harness-side connector.
Figure 5:
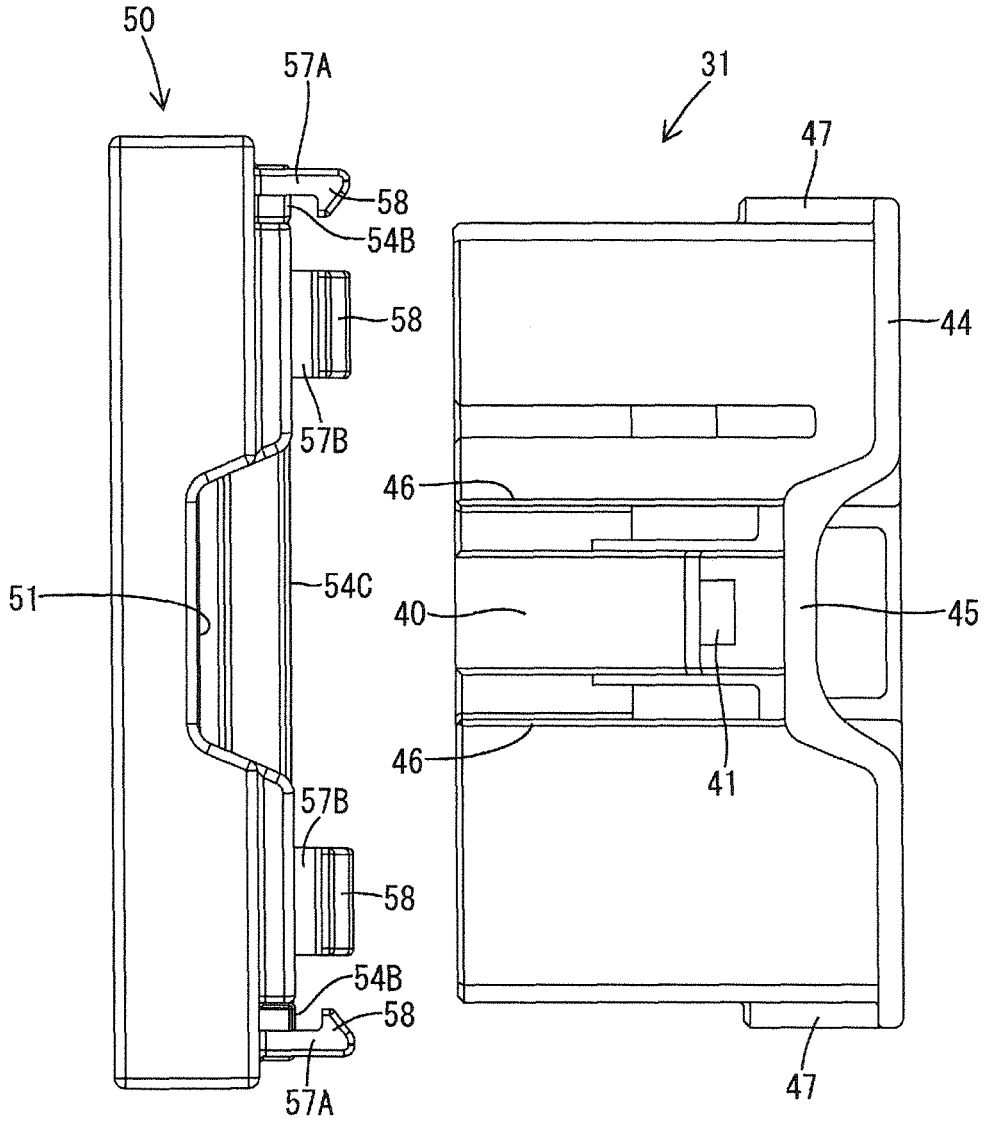
FIG. 5 is a plan view of a female housing and a holder.
Figure 6:
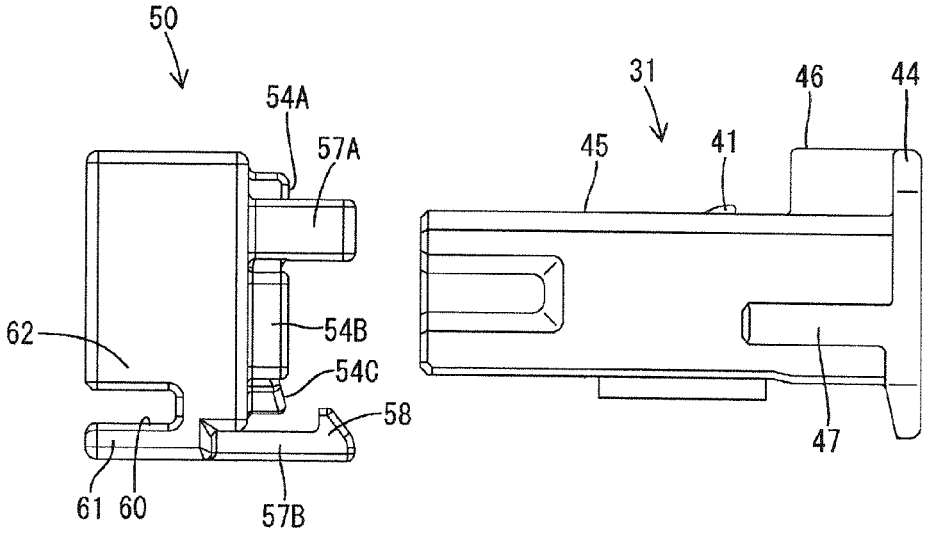
FIG. 6 is a side view of the female housing and the holder.

As shown in FIGS. 4 to 6, the harness-side connector 30 is composed of a female housing 31 and a holder 50.

Figure 7:
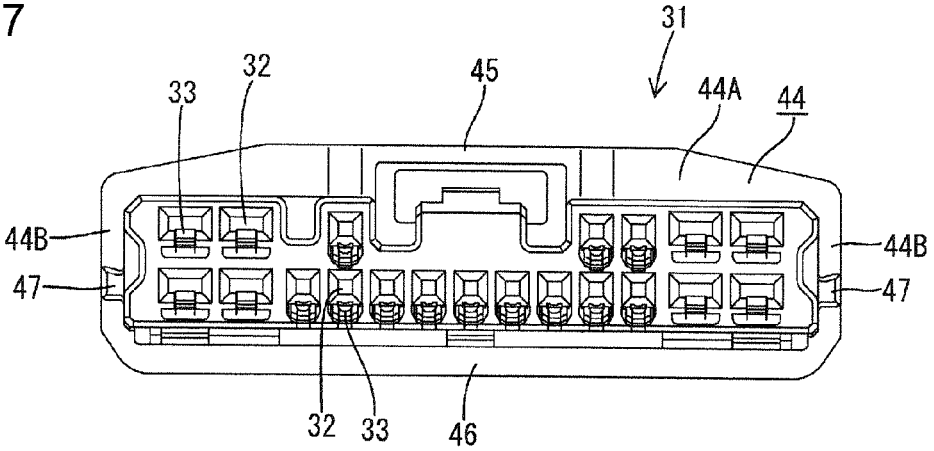
FIG. 7 is a front view of the female housing.

The female housing 31 is made of synthetic resin and in the form of a flat and laterally long block as also shown in FIG. 7. A substantially ⅔ length area of the female housing 31 on the front side is fittable into the receptacle 12 of the male housing 11 of the board connector 10 described above.

A plurality of cavities 32 penetrating in forward and backward directions are formed side by side in the lateral direction in two upper and lower levels in conformity with the arrangement of the terminal connecting portions 16 of the terminal fittings 15 mounted in the above board connector 10. There are also two types of larger and smaller cavities 32, which are arranged at positions corresponding to the larger and smaller terminal fittings 15 of the board connector 10.

Female terminals 35 connected to ends of wires 34 are accommodated into the respective cavities 32 and there are also two larger and smaller types of female terminals 35. As shown by an arrow a of FIG. 4, the female terminal 35 is inserted into the corresponding cavity 32 from behind and is resiliently engaged with a locking lance 33 provided at the bottom surface of the cavity 32 to be retained when being inserted to a proper position.

A side-type retainer for doubly locking the female terminals 35 is mounted in a lower side of the female housing 31. Thus, a retainer mount hole 38 is formed to penetrate through the respective cavities 32 substantially over the entire width at a center position of the lower surface of the female housing 31 in forward and backward directions.

The retainer 37 is likewise made of synthetic resin and, as a whole, in the form of a lattice tightly insertable into the retainer mount hole 38 described above from below, and locking protrusions 37A to be engaged with engaging portions 35A (jaw portions) of the female terminals 35 are arranged in correspondence with the arrangement of the cavities 32. As shown in FIG. 4, the retainer 37 can be mounted at a partial locking position where the respective locking protrusions 37A are retracted downward from the cavities 32 to permit the insertion of the female terminals 35 as shown in FIG. 4 and a full locking position where the respective locking protrusions 37A are located in the cavities 32 to be engageable with the female terminals 35 as shown in FIG. 1.

A lock lever 40 including a projection 41 to be engaged with the lock protrusion 27 of the male housing 11 of the board connector 10 is resiliently displaceably provided while extending backward from the front edge at a widthwise central part of the upper surface of the female housing 31. The extending end of the lock lever 40 serves as an operating portion 42, and the lock lever 40 can be forcibly resiliently displaced by pressing this operating portion 42.

As shown in FIG. 7, a flange 44 is formed over the entire circumference on the rear surface of the female housing 31. An upper flange 44A of this is so formed that an upper end part of a widthwise central part bulges out forward to form a protection wall 45 crossing an upper part of a front end side of the operating portion 42 of the lock lever 40. On the other hand, protection walls 46 stand at both left and right sides of the lock lever 40. These protection walls 45, 46 protect the lock lever 40 from entanglement with the wires 34 and the like.

A lower flange of the flange 44 serves as a finger placing portion 46. By placing fingers on this finger placing portion 46, it is facilitated to press the operating portion 42 of the above lock lever 40 and subsequently pull the female housing 31.

Guide ribs 47 which project from the front surfaces of left and right flanges 44B and are insertable into the guide grooves 28 formed on the inner surfaces of the opposite side walls of the mating male housing 11 are formed on rear edge parts of the left and right outer surfaces of the female housing 31.

The holder 50 formed separately from the female housing 31 is mountable onto this female housing 31.

Figure 8:
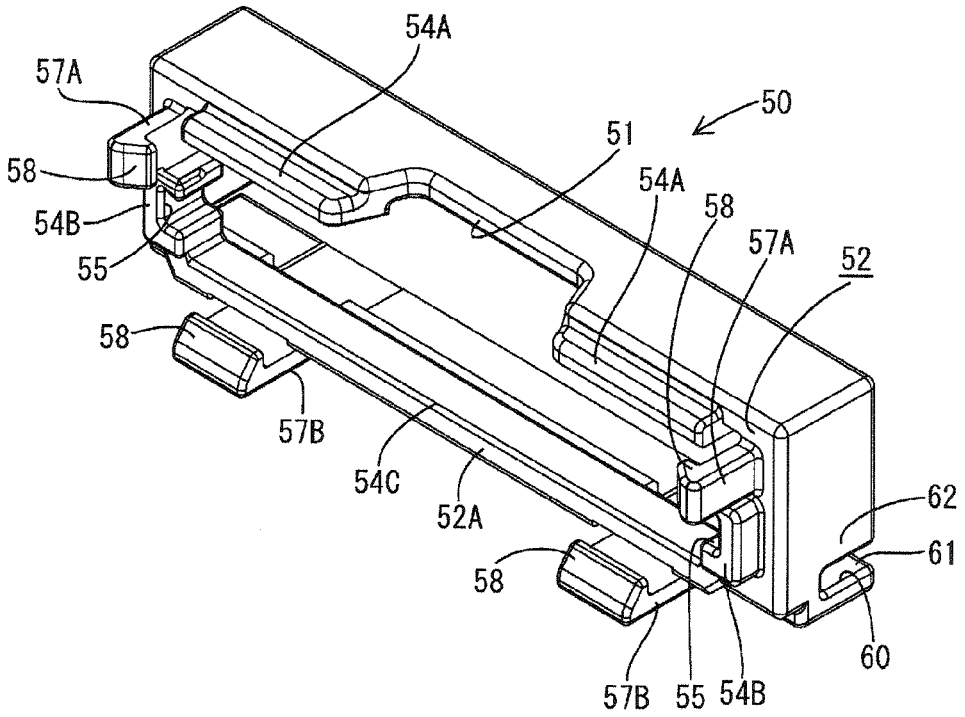
FIG. 8 is a perspective view of the holder when viewed from behind.
Figure 9:
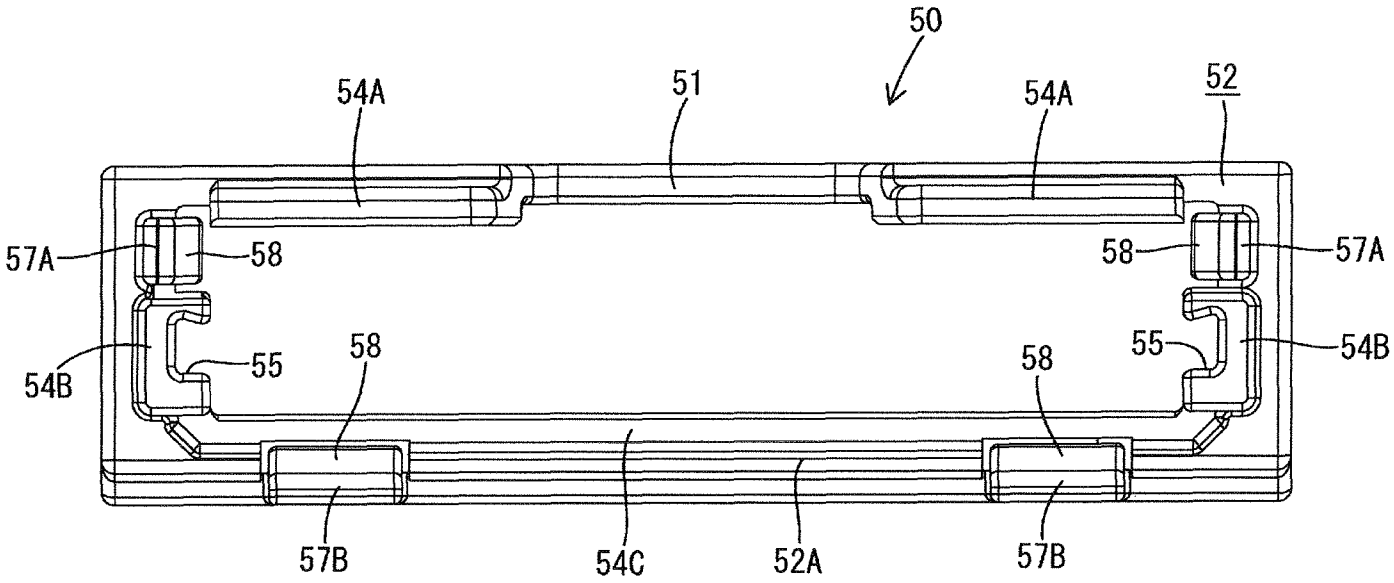
FIG. 9 is a rear view of the holder.

The holder 50 is likewise made of synthetic resin and roughly in the form of a laterally long rectangular frame with depth so as to be fittable on a rear end side of the female housing 31 as also shown in FIG. 8. An escaping recess 51 into which the protection wall 45 of the female housing 31 is to be fitted and allowed to escape is formed in a widthwise central part of the rear edge of the ceiling wall of the holder 50.

Further, a rear wall 52 projecting inwardly a predetermined distance is formed on the inner peripheral edge of the rear end of the holder 50. Note that a lower side 52A of the rear wall is tall and a lower area is recessed into a stepped shape.

Contact portions 54A to 54C which substantially come into contact with the flange 44 of the female housing 31 to prevent the holder 50 from being pushed any further when the holder 50 is fitted onto the female housing 31 from front are formed on the rear wall 52 of the holder 50 as specifically described later.

More specifically, a pair of laterally long left and right first contact portions 54A which come into contact with the upper flange 44A are formed on an upper side of the rear wall 53. Short second contact portions 54B which come into contact with the left and right flanges 44B are formed on left and right sides of the rear wall 52. The both second contact portions 54B are formed with escaping grooves 55 into which the guide ribs 47 formed on the left and right outer surfaces of the female housing 31 are inserted and allowed to escape. A third contact portion 54C which comes into contact with the lower flange, i.e. the finger placing portion 46 is formed substantially over the entire width in an upper area of the lower side 52A of the rear wall. Respective parts of the flange 44 of the female housing 31 with which these contact portions 54A to 54C come into contact serve as a contacted portion of the present invention.

Resiliently displaceable lock arms 57A, 57B which are engaged with the female housing 31 to retain the holder 50 when the holder 50 is pushed onto the female housing 31 up to a proper position and stopped project from the rear surface of the holder 50.

The two first lock arms 57A are formed to project at positions above the second contact portions 54B on the left and right sides of the rear wall 52 of the holder 50, and hook portions 58 on the leading ends are engaged with the rear surfaces of the left and right flanges 44B of the female housing 31 at upper positions.

On the other hand, the two second lock arms 57B are likewise formed to project from opposite left and right ends of a lower area of the lower side 52A of the rear wall and hook portions 58 on the leading ends are respectively engaged with the rear surface of the finger placing portion 46 formed on the lower end of the rear surface of the female housing 31 at positions near the left and right ends of the finger placing portion 46.

Board insertion grooves 60 into which end edges of the board P are substantially tightly inserted are formed at lower positions of the front edges of the left and right walls of the holder 50. Specifically, the board insertion grooves 60 are formed to extend in a depth direction from the front edges of the side walls at positions flush with the upper surface of the lower wall of the holder 50, and have such a depth that the end edges of the board P reach the back ends when the female housing 31 mounted with the holder 50 is properly fitted into the receptacle 12 of the mating male housing 11 as specifically described later.

By forming the board insertion grooves 60 as described above, the lower wall of the holder 50 over the entire width functions as a lower locking portion 61 to be engaged with the lower surface of the board P. On the other hand, upper edge parts of the board insertion grooves 60 in the side walls of the holder 50 function as upper locking portions 62 to be engaged with the upper surface of the board P.

Next, functions of this embodiment are described.

As shown in FIGS. 1 and 2, the board connector 10 is placed and surface-mounted on the board P at a predetermined position near an end edge of the board P such that a leading end part of the male housing 11 projects a predetermined distance from the end edge of the board P, and the board connecting portions 17 of the respective terminal fittings 15 are connected to the corresponding conductive paths by soldering and the mounting plates 22 of the left and right metal fixtures 20 are fixed to the board P by soldering.

In the harness-side connector 30, as shown in FIG. 4, the female terminal 35 connected to the end of the wire 34 is inserted into each cavity 32 provided in the female housing 31 from behind and primarily locked by the locking lance 33 with the retainer 37 held at the partial locking position. Subsequently, the retainer 37 is pushed to the full locking position, whereby the respective female terminals 35 are doubly locked (see FIG. 1). Here, the wires 34 drawn out from the rear surface of the female housing 31 are appropriately bundled to form a wiring harness.

Subsequently, the holder 50 is fitted onto the female housing 31 in which the female terminals 35 are accommodated and doubly locked as described above as shown by an arrow b of FIG. 4. When the holder 50 is pushed and this pushing operation comes to a final stage, the guide ribs 47 are inserted into and guided by the escaping grooves 55 and the holder 50 is pushed while the respective lock arms 57A, 57B come into contact with the left and right flanges 44B and the finger placing portion 46 to be resiliently deformed. The pushing operation is stopped when the contact portions 54A to 54C of the holder 50 come into contact with the contacted portions set on the flange 44 of the female housing 31. At this time, the hook portions 58 of the lock arms 57A, 57B pass the left and right flanges 44B and the finger placing portion 46, whereby the lock arms 57A, 57B are engaged with the left and right flanges 44B and the finger placing portion 46 while being restored and displaced. In this way, the holder 50 is mounted at a proper position on a rear end part of the female housing 30 as shown in FIG. 1.

Figure 10:
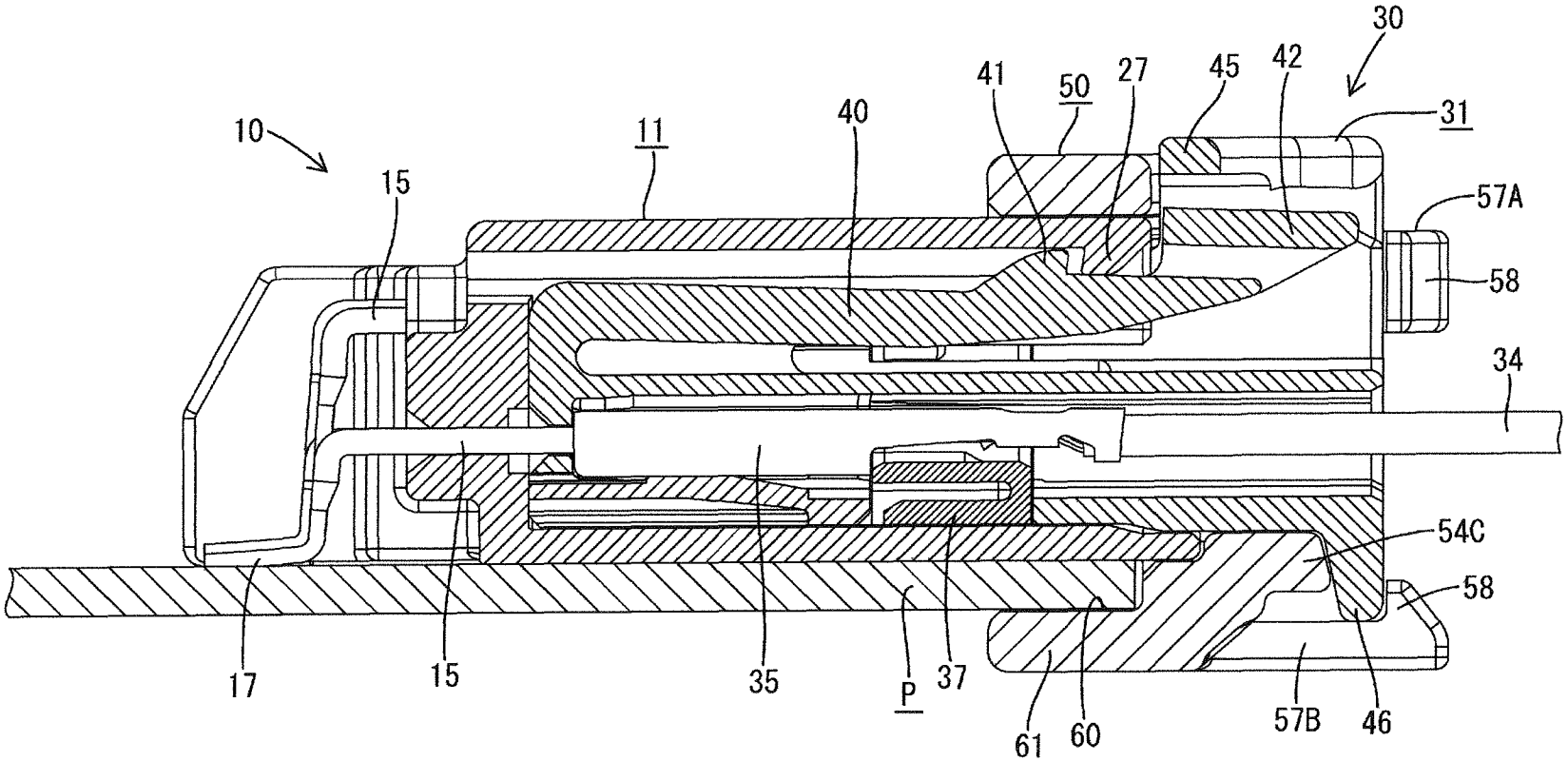
FIG. 10 is a side view in section showing a state where the harness-side connector is connected to the board connector.

The harness-side connector 30 assembled in this way is connected to the board connector 10 as shown by an arrow c of FIG. 1. Specifically, the female housing 31 is fitted into the receptacle 12 of the mating male housing 11. As the harness-side connector 30 is pushed in, the leading end side of the receptacle 12 enters the holder 50 and the lock lever 40 is resiliently deformed. When the harness-side connector 30 is pushed to a proper position where the leading end of the female housing 31 comes into contact with the terminal holding portion 13, the male and female housings 11, 31 are locked in a properly connected state while the lock lever 40 is restored and displaced as shown in FIG. 10. This causes the corresponding terminal fittings 15 and female terminals 35 to be properly electrically connected.

Further, during this time, the end edges of the board P are inserted into the board insertion grooves 60 provided in the holder 50. When the two housings 11, 31 are properly connected, the end edges reach the back ends of the board insertion grooves 60.

Figure 11:
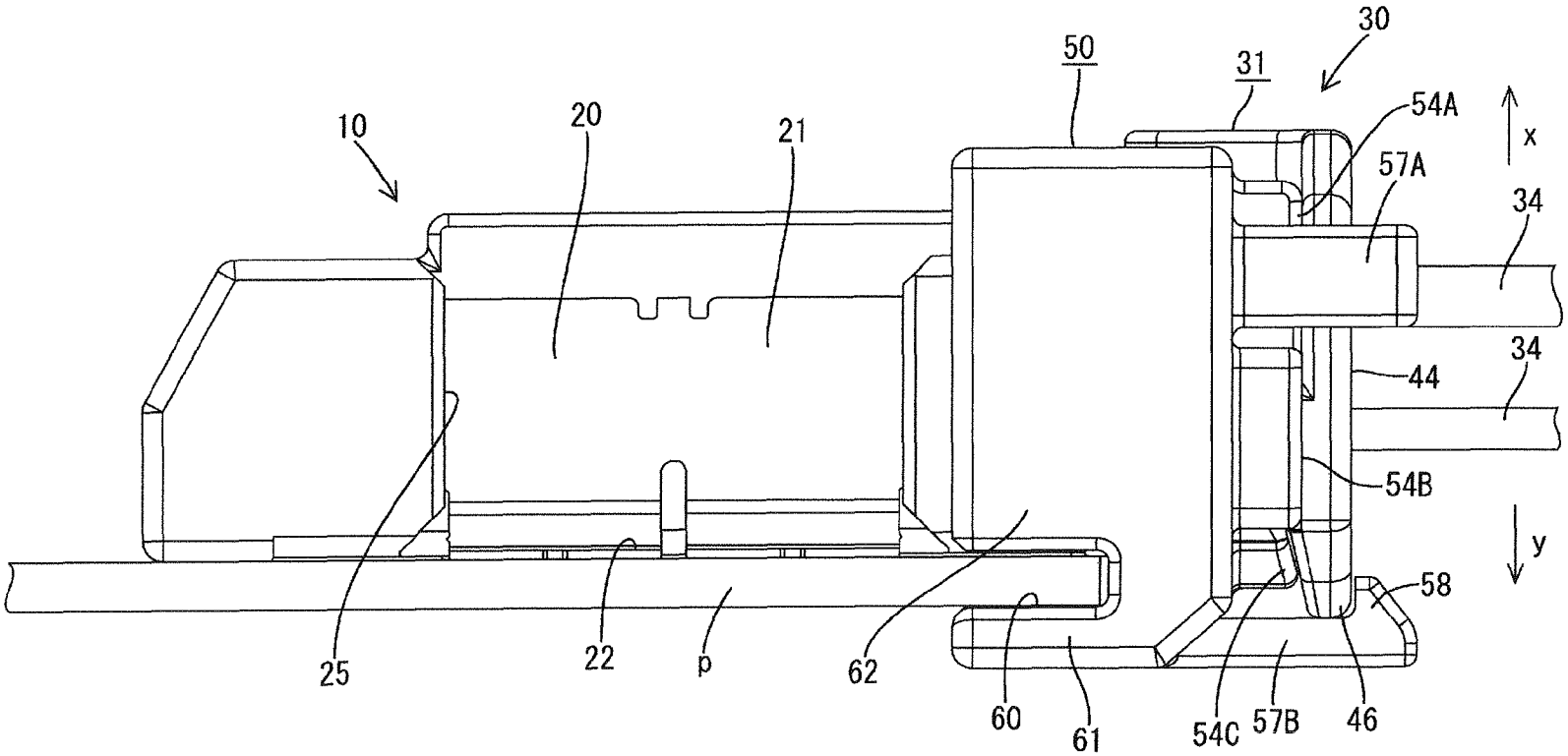
FIG. 11 is a side view showing the state of FIG. 10.

Even if a bundle of wires 34 (wiring harness) drawn out backward from the harness-side connector 30 is pulled, for example, upward as shown by an arrow x of FIG. 11 in a state where the connection of the two connectors 10, 30 is completed as shown in FIG. 11, the lower locking portion 61 provided in the holder 50 is engaged with the lower end edge of the board P over a wide range, thereby restricting the inclination of the female housing 31 and, further, the board connector 10 connected thereto and eventually preventing an excessive stress from acting on soldered parts of the metal fixtures 20.

Further, if the bundle of wires 34 (wiring harness) is pulled downward as shown by an arrow y of FIG. 11, the female housing 31 is more or less inclined in a clockwise direction of FIG. 11, but the left and right upper locking portions 62 are engaged with the end edges of the upper surface of the board P, thereby more reliably restricting the inclination of the female housing 31 and, further, the board connector 10 connected thereto in the clockwise direction.

As described above, according to this embodiment, the holder 50 mounted on the harness-side connector 30 includes the board insertion grooves 60 into which the end edges of the board P are inserted when the connector 30 is properly connected to the mating board connector 10, and the end edges of the board P are sandwiched by the locking portions 61, 62 provided at the lower and upper sides of the board insertion grooves 60. Thus, even if the bundle of the wires 34 (wiring harness) drawn out backward from the harness-side connector 30 is pulled upward or downward, the locking portions 61, 62 are engaged with the board P, thereby restricting the inclination of the female housing 31 and, further, the mating board connector 10 and eventually preventing an excessive stress from acting on the soldered parts of the metal fixtures 20.

Thus, a situation can be prevented where the soldered parts of the metal fixtures 20 are broken, the board connector 10 is displaced and eventually soldered parts of the terminal fittings 15 are damaged.

Since the holder 50 including the locking portions 61, 62 is formed separately from the female housing 31 and the lock arms 57A, 57B are provided only on the holder 50, it is sufficient to create only a manufacturing mold for the holder 50 anew with a manufacturing mold for the female housing 31 kept as it is. This configuration can be inexpensively dealt with.

If the locking portions 61, 62 provided in the holder 50 are structured to be integral with the female housing 31, the side-type retainer 37 cannot be mounted into the female housing 31 or the arrangement position thereof is restricted due to a possibility of interfering with the locking portions 61, 62. However, since the locking portions 61, 62 are provided in the holder 50 formed separately from and mounted later on the female housing 31, the arrangement position of the side-type retainer 37 can be arbitrarily set.

Note that the following structure may be adopted as a related technology.

The board connector 10 tends to be made thinner due to a height reduction request. In such a case, if the wires 34 drawn out from the mating harness-side connector 30 are pulled upward to incline this connector 30, the upper surface of the thinned receptacle 12 may be broken.

Figure 12:
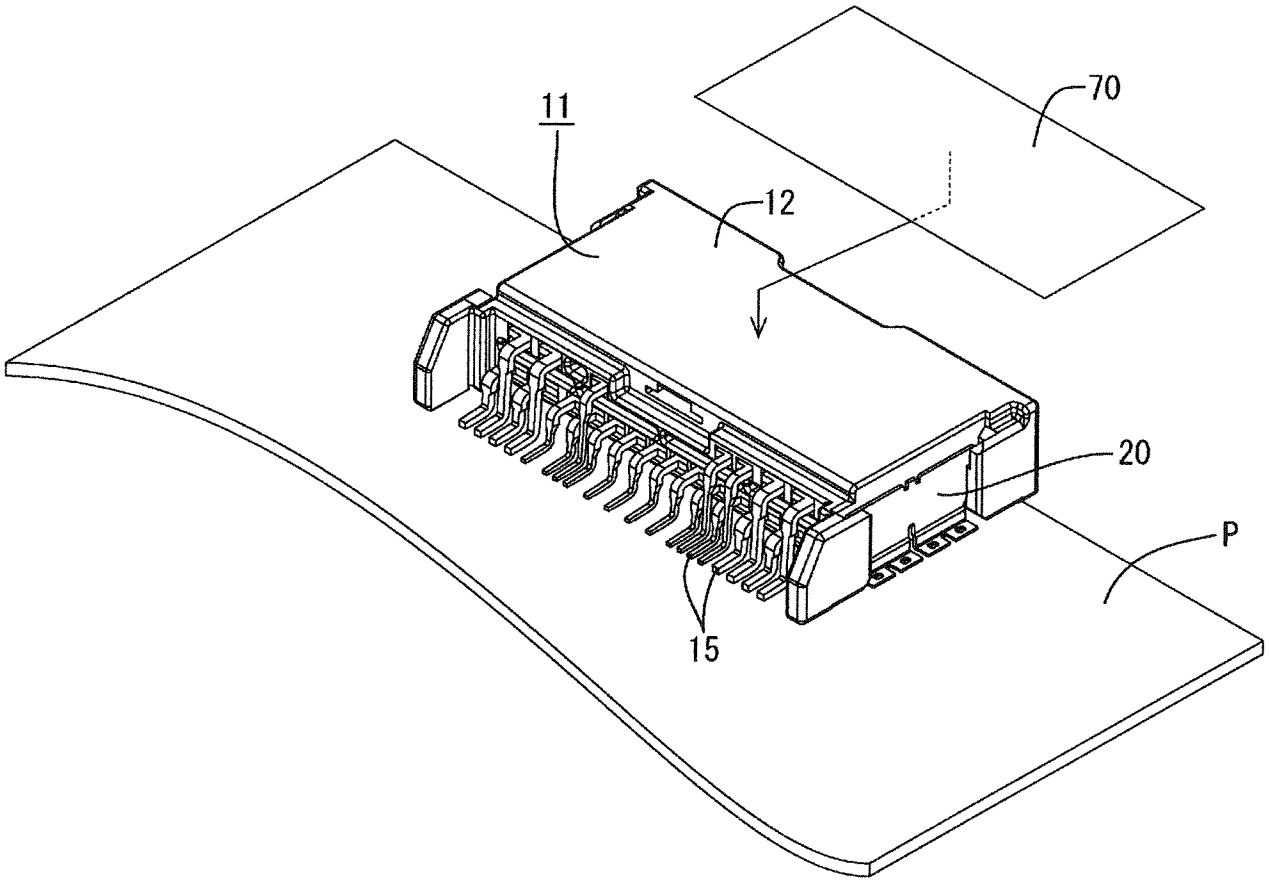
FIG. 12 is a perspective view showing a reinforcing structure of a male housing.

As an example of a measure to prevent this, a high-strength film 70 or a metal film may be bonded to the upper surface of the receptacle 12 to reinforce the upper surface as shown in FIG. 12. Since reinforcement is made by a separate part, the need for a design change of the male housing 11 in the board connector 10 can be eliminated.

The present invention is not limited to the above described and illustrated embodiment. For example, the following embodiments are also included in the technical scope of the present invention.

The positions of the board insertion grooves provided in the holder are not limited to the positions illustrated in the above embodiment and may, for example, be other positions such as intermediate positions of the side walls in the height direction. Even at the intermediate positions of the side walls in the height direction, locking portions for sandwiching the board can be formed at both upper and lower sides of the board insertion grooves.

Out of the locking portions provided in the holder, the upper locking portions to be engaged with the upper surface of the board may be omitted. Such a configuration is also included in the technical scope of the present invention.

The shapes and arrangement positions of the contact portions provided on the holder to stop the pushing operation can be arbitrary shapes and arbitrary positions as long as the contact portions are provided on existing parts of the female housing.

The shapes and arrangement positions of the lock arms provided on the holder to retain the holder can be arbitrary shapes and arbitrary positions as long as the lock arms can be engaged with existing parts of the female housing.

Although the holder is substantially in the form of a frame and fitted and mounted onto the female housing from front in the above embodiment, the shape and mounting method of the holder can be arbitrarily set according to conditions such as the shape of the female housing.

The invention claimed is:

1. A connector to be connected to a board connector including a receptacle and metal fixtures provided on opposite side surfaces and fixed to an upper surface of a board by soldering, the board further having a lower surface opposite the upper surface, the connector comprising:

a housing connected to an end of a wiring harness and fittable into the receptacle of the board connector; and a holder formed separately from the housing;

wherein the holder includes:

a lock member which is resiliently engaged with the housing to lock the holder in a state mounted on the holder; and at least one board insertion groove formed by opposed upper and lower locking portions that are engaged respectively with the upper and lower surfaces of the board to sandwich the board when the housing is fit into the receptacle of the board connector after the holder is mounted on the housing.

2. The connector of claim 1, wherein the holder is in the form of a frame fittable onto the housing from front and includes a contact portion which restricts a pushing operation by coming into contact with a contacted portion set on the housing and a lock arm which is resiliently engaged with the rear surface of the housing to retain the holder when the contact portion comes into contact with the contacted portion.

3. The connector of claim 2, wherein a retainer mount hole into which a retainer for locking and retaining terminal fittings accommodated in the housing is to be mounted is formed in a side surface of the housing.

4. The connector of claim 1, wherein a retainer mount hole into which a retainer for locking and retaining terminal fittings accommodated in the housing is to be mounted is formed in a side surface of the housing.

* * * * *